US007024829B2

(12) United States Patent
Sharp et al.

(10) Patent No.: US 7,024,829 B2
(45) Date of Patent: Apr. 11, 2006

(54) RIDGE VENT FOR TILE ROOFS

(75) Inventors: Thomas G. Sharp, San Ramon, CA (US); W. Brent Taylor, Manhattan Beach, CA (US)

(73) Assignee: Pacific Award Metals, Inc., Baldwin Park, CA (US)

( * ) Notice: Subject to any disclaimer, the term of this patent is extended or adjusted under 35 U.S.C. 154(b) by 10 days.

(21) Appl. No.: 10/738,891

(22) Filed: Dec. 16, 2003
(Under 37 CFR 1.47)

(65) Prior Publication Data

US 2004/0128920 A1 Jul. 8, 2004

Related U.S. Application Data

(63) Continuation of application No. 09/905,585, filed on Jul. 12, 2001, now Pat. No. 6,662,509.

(60) Provisional application No. 60/218,023, filed on Jul. 12, 2000.

(51) Int. Cl.
*E04H 12/28* (2006.01)

(52) U.S. Cl. ..... 52/199; 52/57; 52/96; 454/250; 454/260; 454/365

(58) Field of Classification Search ..... 52/199, 52/95–96, 57; 454/250, 260, 365
See application file for complete search history.

(56) References Cited

U.S. PATENT DOCUMENTS 2,147,240 A 2/1939 Calkins
2,200,031 A 5/1940 Lee
3,036,508 A 5/1962 Halvorson
3,073,235 A * 1/1963 Randall et al. ..... 454/250
3,236,170 A 2/1966 Meyer et al.

(Continued)

FOREIGN PATENT DOCUMENTS

CA 521165 1/1956

(Continued)

OTHER PUBLICATIONS

**84-183473/30 (Abstract)—Fleck O., Hollow Roof Ridge Tile; Jan. 17, 1983—DE301273 issued on Jul. 19, 1984 as DE 3219302.

*Primary Examiner*—Carl D. Friedman
*Assistant Examiner*—Yvonne M. Horton
(74) *Attorney, Agent, or Firm*—R. Reams Goodloe, Jr.

(57) ABSTRACT

A ridge vent for tile roofs. The vent includes first and second sub-flashing portions for spanning air gaps provided between the upper reaches of a roof deck and below a centrally located ridge beam. A plurality of ventilation apertures are provided in each of the sub-flashing portions. A top cap flashing is provided for attachment above the ridge beam. Included in the top cap flashing are a plurality of ventilation apertures defined by edge wall portions. A tile roof is provided, of the flat, low profile undulating, or of the S-tile (undulating) type. Tiles are provided in rows up to the edge of the sub-flashing. The gap between the top of the tiles and the bottom of the top cap flashing is preferably provided with a weathertight seal. Ridge cap tiles are provided in conventional stacked fashion running along above the top cap flashing. As a result, a generally triangular ventilation gap is provided along and below the lateral edges of the ridge cap tile, which allows air to enter and leave the attic space below the tile roof, while providing high resistance to wind blown water.

36 Claims, 13 Drawing Sheets

U.S. PATENT DOCUMENTS

| | | | | | |
|---|---|---|---|---|---|
| 3,323,266 | A | | 6/1967 | Dalkas | |
| 3,481,263 | A | * | 12/1969 | Belden | 454/365 |
| 3,625,134 | A | * | 12/1971 | Smith | 454/365 |
| 3,683,785 | A | | 8/1972 | Grange | |
| 3,783,570 | A | | 1/1974 | Storch | |
| RE27,943 | E | | 3/1974 | Smith | |
| 4,280,399 | A | | 7/1981 | Cunning | |
| 4,325,290 | A | * | 4/1982 | Wolfert | 454/365 |
| 4,558,637 | A | * | 12/1985 | Mason | 454/365 |
| 4,642,958 | A | | 2/1987 | Pewitt | |
| 4,685,265 | A | * | 8/1987 | Cooper | 52/277 |
| 4,903,445 | A | * | 2/1990 | Mankowski | 52/199 |
| 5,009,149 | A | | 4/1991 | MacLeod et al. | |
| 5,022,314 | A | | 6/1991 | Waggoner | |
| 5,050,489 | A | * | 9/1991 | Mankowski | 454/365 |
| 5,060,431 | A | | 10/1991 | MacLeod et al. | |
| 5,092,225 | A | | 3/1992 | Sells | |
| 5,095,810 | A | * | 3/1992 | Robinson | 454/365 |
| 5,112,278 | A | * | 5/1992 | Roberts | 454/365 |
| 5,326,318 | A | * | 7/1994 | Rotter | 454/365 |
| 5,328,407 | A | | 7/1994 | Sells | |
| 5,352,154 | A | | 10/1994 | Rotter et al. | |
| 5,473,847 | A | | 12/1995 | Crookston | |
| 5,547,675 | A | * | 8/1996 | Canich | 502/117 |
| 5,593,348 | A | | 1/1997 | Rickert | |
| 5,603,657 | A | * | 2/1997 | Sells | 454/359 |
| 5,605,022 | A | * | 2/1997 | Fulton | 52/199 |
| 5,697,842 | A | | 12/1997 | Donnelly | |
| 5,738,581 | A | * | 4/1998 | Rickert et al. | 454/365 |
| 5,766,071 | A | | 6/1998 | Kirkwood | |
| 5,803,805 | A | * | 9/1998 | Sells | 454/364 |
| 6,015,343 | A | * | 1/2000 | Castillo et al. | 454/365 |
| 6,050,039 | A | | 4/2000 | O'Hagin | |
| 6,077,159 | A | * | 6/2000 | Clayton | 454/250 |
| 6,128,870 | A | | 10/2000 | Kohler | |
| 6,662,509 | B1 | * | 12/2003 | Sharp et al. | 52/199 |
| 2002/0068522 | A1 | | 6/2002 | Dixon | |
| 2002/0187745 | A1 | | 12/2002 | Smith | |
| 2002/0194799 | A1 | | 12/2002 | Sharp | |
| 2003/0140582 | A1 | | 7/2003 | Sells | |
| 2004/0000101 | A1 | | 1/2004 | Dixon | |

FOREIGN PATENT DOCUMENTS

| | | | |
|---|---|---|---|
| DE | 42 18270 | A1 | 1/1993 |
| EP | 0 288 020 | A2 | 10/1988 |
| FR | 721142 | A | 2/1932 |
| FR | 2399515 | | 8/1977 |
| GB | 00005876 | | 0/1882 |
| GB | 2136558 | A | 9/1984 |
| GB | 2176002 | A | 12/1986 |
| GB | 2211287 | A | 6/1989 |
| JP | 57-52736 | A | 3/1982 |
| NL | 062025 | B | 11/1948 |

* cited by examiner 28
120
F
A2
92
102
44
48
84
50
36
34
A1
40
38
80
90
96
100₁
30
46
42
100₂
164
F
130₁
5
V
162
V
V
170
160
V
5
V
164
F
130₂

400
402
400
404
A1
402
X
404
406
400
A1
404
406
410
11
Y

RIDGE VENT FOR TILE ROOFS

PRIORITY

This application is a Continuation application and claims priority under 35 USC § 120 of non-provisional application Ser. No. 09/905,585 filed on Jul. 12, 2001 now U.S. Pat. No. 6,662,509 which claims the benefit under 35 U.S.C. § 119(e) of prior U.S. Provisional Application Ser. No. 60/218,023 filed on Jul. 12, 2000, the disclosure of each is incorporated herein by this reference.

TECHNICAL FIELD

This invention relates to ridge type roof vents, and more particularly to a novel ridge type roof vent designed for placement on the ridge of a tile roof, including heavy or light tiles, whether slate, clay, or of similar looking material, to allow ventilation of the space below the tile roof.

BACKGROUND

Although a variety of designs exist for roof vents, historically, "ridge type" roof vents have not been widely used for tile roofs. This is rather easy to understand, since although such a design would reduce the number of roof penetrations necessary to achieve adequate ventilation, the cumbersome and weighty nature of roof tiles has not been generally conducive to incorporation of a ridge type vent system in the roof design. And, although a few designs have been proposed or actually used, in so far as is known to us, prior art ridge vent designs have not adequately addressed the problem of preventing ingress of wind blown water, as might occur during a thunderstorm or hurricane, for example. Thus, it would be desirable to provide a new ridge vent design that is resistant to entry of wind blown water, especially if such a design were provided in a structurally strong, low profile, artistically pleasing ridge top roof vent system suitable for tile roofs or the like.

SUMMARY

We have invented a novel ridge type roof vent for incorporation in tile or tile type roof applications. The ridge vent design may be easily adapted for various tile roofs, ranking from flat tile to high profile (undulating design) tile roof structures. The ridge vent design is simple and strong enough to support the necessary tile and weather loads (wind, water, snow, ice, etc.), even though relatively lightweight. The roof vent designs are relatively inexpensive and easy to manufacture, and otherwise superior to heretofore known roof vent designs for tile roofs. Importantly, my ridge type roof vent for tile roofs provides exemplary protection against entry of wind driven water, as well as unwanted debris, insects, or vermin, while allowing a preselected ventilation volume per running foot of installed roof vent.

The new ridge vent design utilizes (a) a pair of opposing sub-flashing portions, each having therein a longitudinally running, preferably substantially vertically oriented vent apertures that allow passage of air therethrough, and (b) a top cap portion, having therein longitudinally running vent apertures spaced a preselected distance from the center longitudinal axis thereof.

Each of the sub-flashing portions spans a gap in the roofing deck adjacent the longitudinally running ridge support. Preferably, a top batten is longitudinally attached above the sub-flashing to affix the sub-flashing to the roof deck.

Tiles are mounted above the top batten, in conventional fashion, sloping down the roof.

An elongated top cap portion is then affixed above the ridge beam. The top cap portion supports the ridge cap tiles. Also, when a low profile or S-type tile design is utilized, an appropriate weather block is affixed between the top of the undulating tile and the lower side of the top cap portion. In a flat tile design, the underside of the top cap is directly sealed to the top of the adjacent flat tiles.

OBJECTS, ADVANTAGES, AND FEATURES OF THE INVENTION

An important and primary object of the present invention resides in the provision of a novel, ridge type vent that is easy to manufacture and install on tile type roofs. Other important objects, advantages, and novel features include a ridge vent which:

can be manufactured in a simple, straightforward manner;

in conjunction with the preceding object, have the advantage that they can be configured by installation personnel to quickly and efficiently utilize the method disclosed herein to provide a ridge vent in a tile roof;

provides a ridge type vent that is fully protective from windblown debris, large insects, and vermin; and that are structurally designed to provide sturdy support for heavy tiles;

that provide appropriate variations in the design for use in either flat tile roofs or in undulating type tile roofs.

Other aspects of various embodiments will become apparent to those skilled in the art from the foregoing and from the detailed description that follows and the appended claims, evaluated in conjunction with the accompanying drawings.

BRIEF DESCRIPTION OF THE DRAWING

In order to enable the reader to attain a more complete appreciation of the invention, and of the novel features and the advantages thereof, attention is directed to the following detailed description when considered in connection with the accompanying drawings, wherein.

The foregoing figures, being merely exemplary, contain various elements that may be present or omitted from actual implementations depending upon the circumstances. An attempt has been made to draw the figures in a way that illustrates at least those elements that are significant for an understanding of the various embodiments and aspects of the invention. However, various other elements of the ridge vent system and accompanying roofing system are also shown and briefly described to enable the reader to understand how various optional features may be utilized in order to provide an efficient, ridge vent.

DETAILED DESCRIPTION

Figure 1:
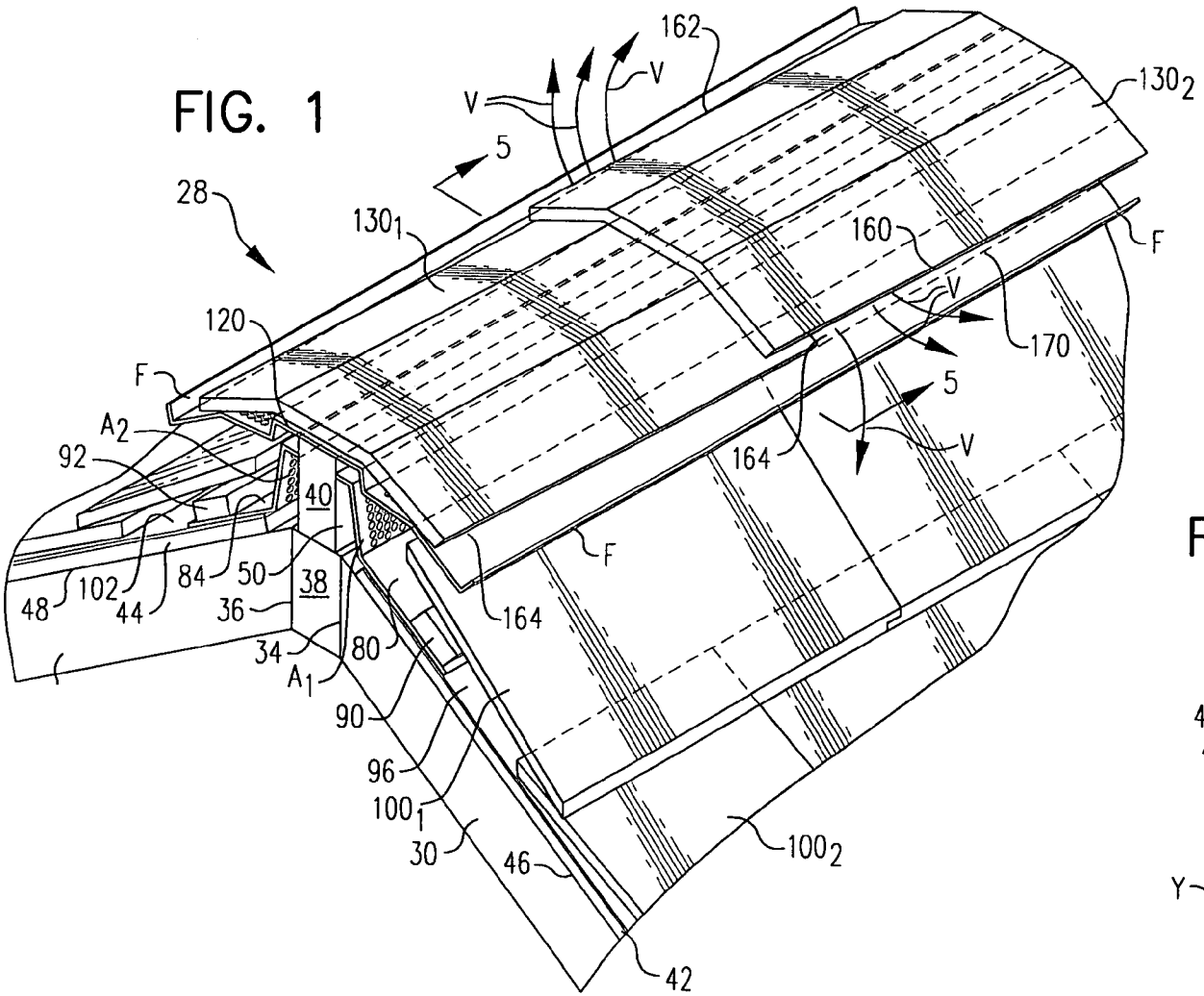
FIG. 1 is a perspective view of an exemplary ridge vent system installed in a flat type tile roof, showing the use of the sub-flashing to span a gap in the roof deck, and a ventilated top cap flashing that supports a tile cap.
Figure 5:
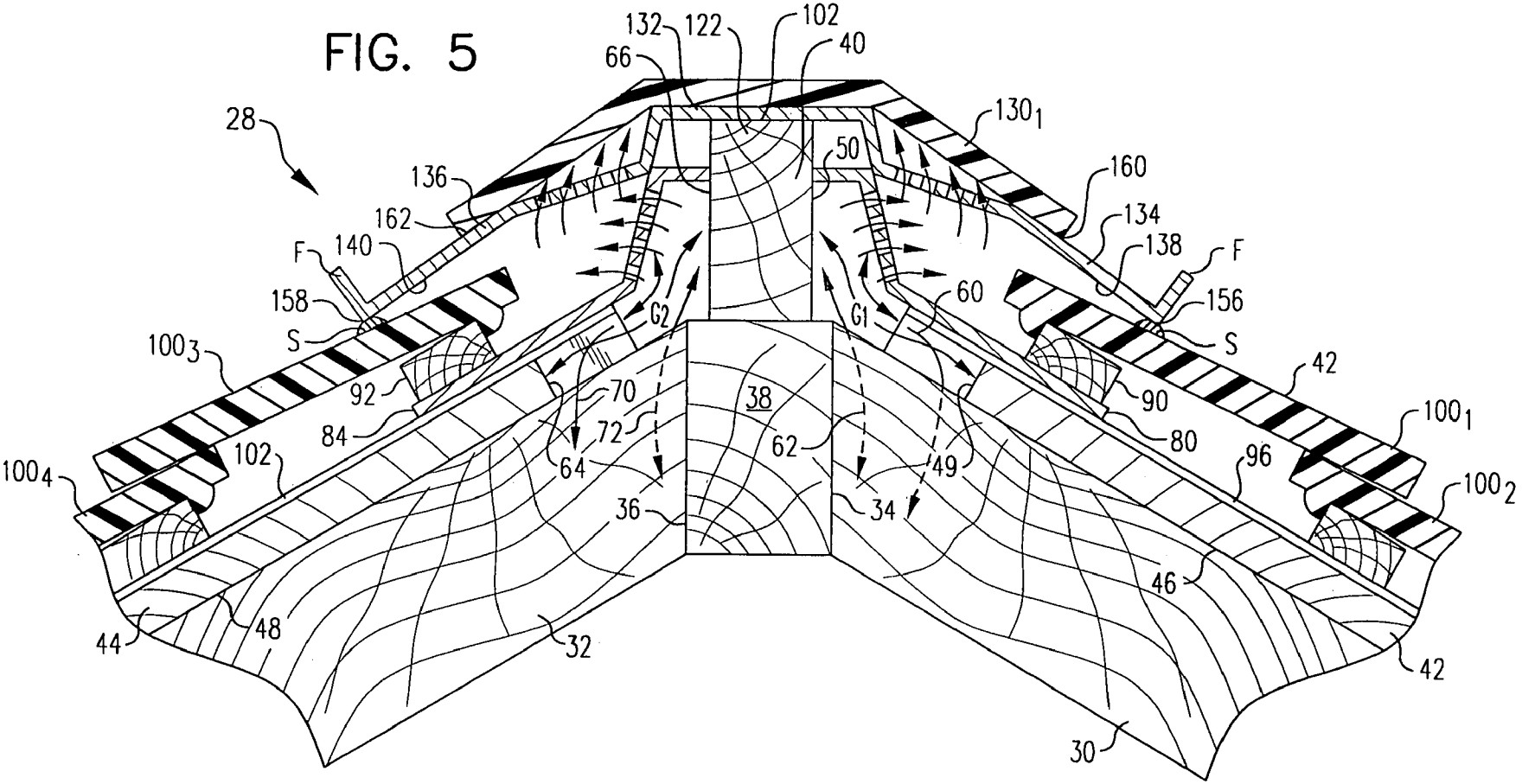
FIG. 5 is a cross-sectional view of the roof vent system first illustrated in FIG. 1 above taken across line 5—5 of FIG. 1, now showing the ridge cap tiles at a longitudinal location where the lateral edges extend down to the flashing.

Attention is directed to FIGS. 1 and 5, where respectively a perspective view and a cross-sectional view are shown of a ridge vent system installed in a flat tile type roof system 28. Roof rafters 30 and 32 have ridge ends 34 and 36 ending at a center beam 38. Above the center beam 38 is mounted a longitudinally running ridge beam 40 which extends across the roof system. First 42 and second 44 roof decking is affixed above the upper sides 46 and 48 of the respective rafters 30 and 32. Either through roof deck 42, or preferably above the upper end 49 of first roof deck 42 and up to the first side 50 of ridge beam 40, a first air gap $G_1$ is provided. First air gap $G_1$ is provided to allow air to flow upward or downward in the direction of reference arrows 60 and 62, respectively. Between the upper end 64 of second roof deck 44 and the second side 66 of ridge beam 40, a second air gap $G_2$ is provided to allow air to flow upward or downward in the direction of reference arrows 70 and 72, respectively.

Figure 2:
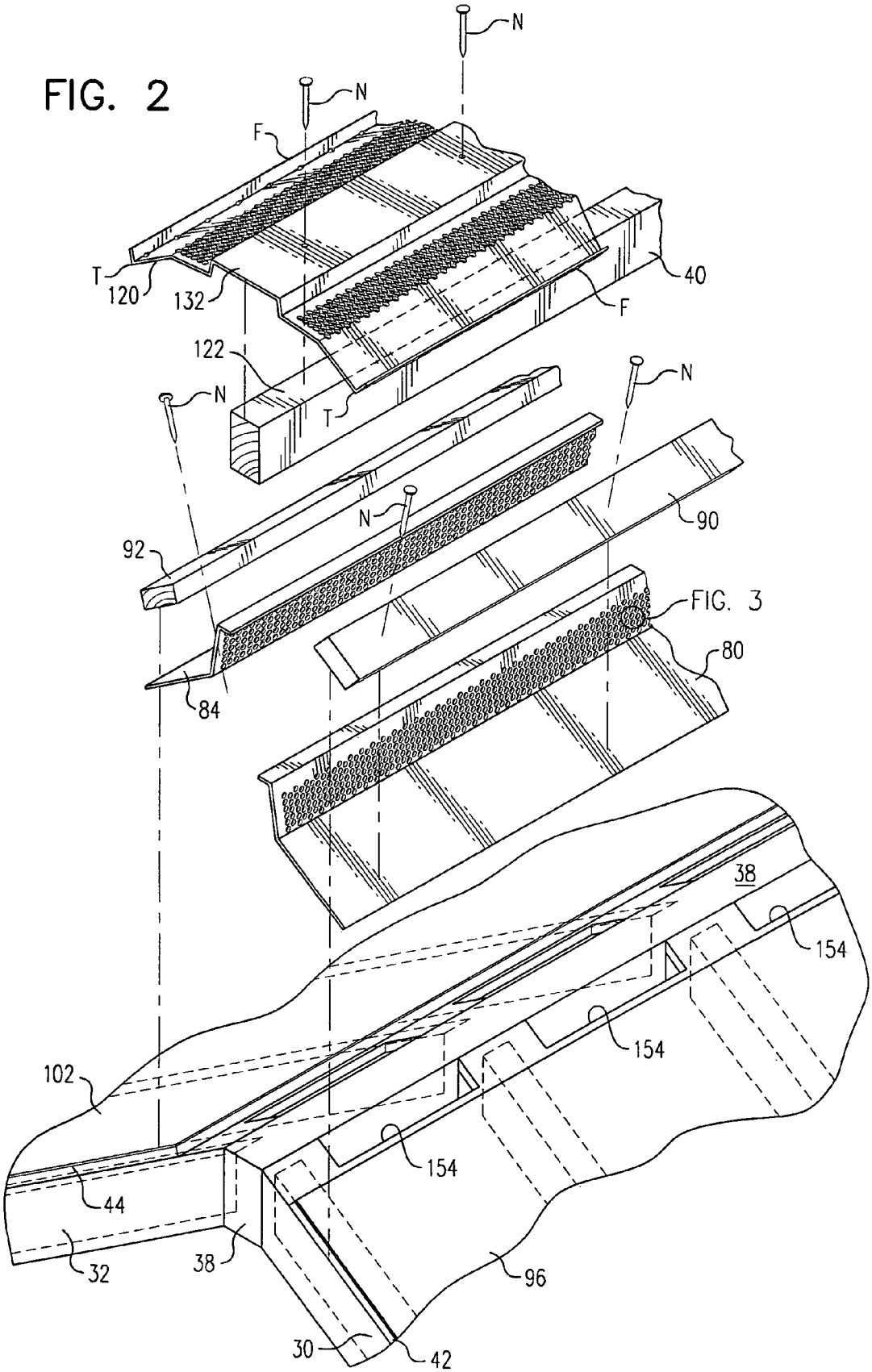
FIG. 2 is an exploded perspective view of the ridge vent system shown in FIG. 1, now showing the various parts and pieces that make up the system, including (a) a roof decking having therein voids defined by sidewall portions to allow upward flow of ventilation air through the roof deck, (b) first and second sub-flashing portions, one for each side of the roof, (c) first and second battens for securing the first and second sub-flashing portions, respectively, (d) a ridge beam that extends longitudinally across the ridge of a roof, (e) a top cap flashing portion that is mounted above the ridge beam, and over which a top cap or ridge-cap row of tiles is mounted.

A first longitudinally extending sub-flashing 80 having a plurality of ventilation apertures $A_1$ therein is provided to span gap $G_1$. A second longitudinally extending sub-flashing 84 having a plurality of apertures $A_2$ therein is provided to span gap $G_2$. A first top batten 90 is provided to affix first sub-flashing 80 to the first roof deck 42. A second top batten 92 is provided to affix the second sub-flashing 84 to the second roof deck 44. Each of first and second top battens 90 and 92 may be secured to first and second roof decks 42 and 44, respectively, by nails or other suitable fasteners N as indicated in FIG. 2. First water proof roof felting 96 is provided above first roof deck 42, below flat tiles generally noted with reference numeral 100, but in this case, more specifically shown as $\mathbf{100}_1$ and $\mathbf{100}_2$. A second water proof roof felting 102 is provided above second roof deck 44, below flat tiles $\mathbf{100}_3$ and $\mathbf{100}_4$.

A top cap flashing 120 is mounted over the top 122 of ridge beam 40. The top cap flashing 120 is longitudinally extending to support a plurality of ridge cap tiles 130, or as more specifically identified, cap tiles in a series from $\mathbf{130}_1$, $\mathbf{130}_2$, to $\mathbf{130}_Z$, where Z is a positive integer. In the embodiment shown in this FIG. 1, the top cap flashing 120 has a downwardly directed U-shaped center section 132 and a pair of opposing first and second outward wing portions 134 and 136, each of which may be bounded at the outer tip T thereof by a an upwardly directed flange portion F. Preferably, a sealant layer S is provided between the lower side 138 and 140 of wing portions 134 and 136, respectively, and the adjacent tiles $\mathbf{100}_1$ and $\mathbf{100}_3$, respectively.

Figure 11:
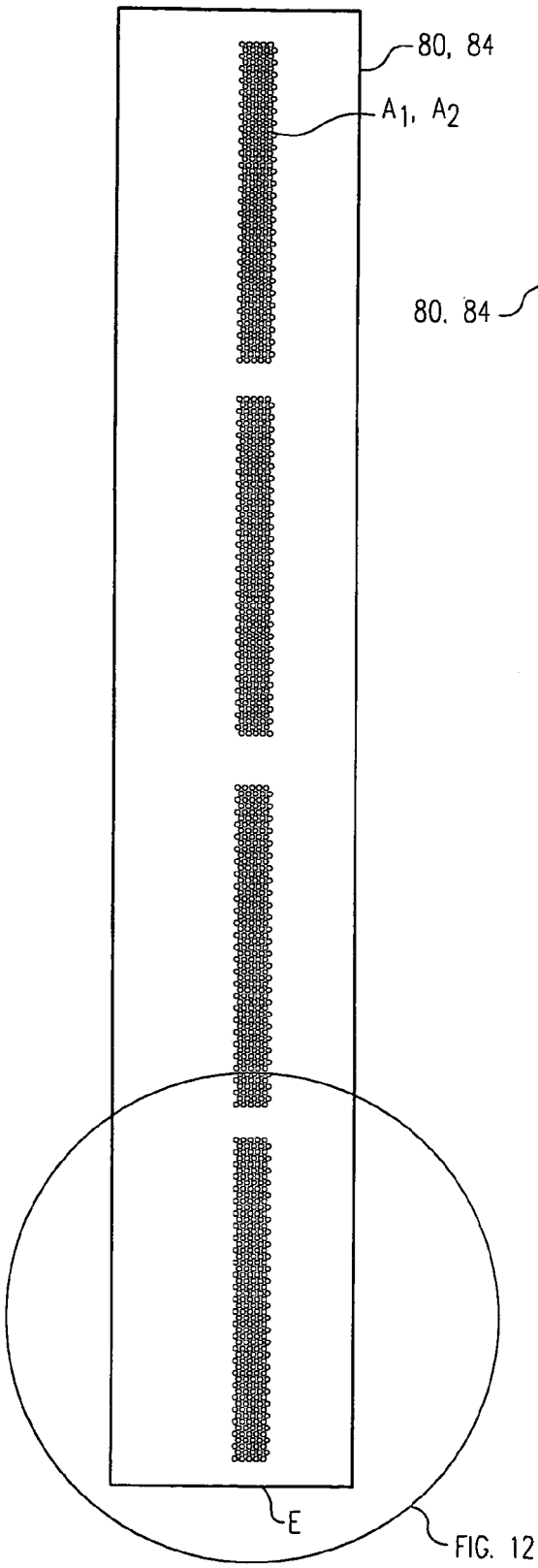
FIG. 11 is a top plan view of a section of subflashing, shown flat during manufacture of the subflashing, before the subflashing is formed and shaped for installation.
Figure 12:
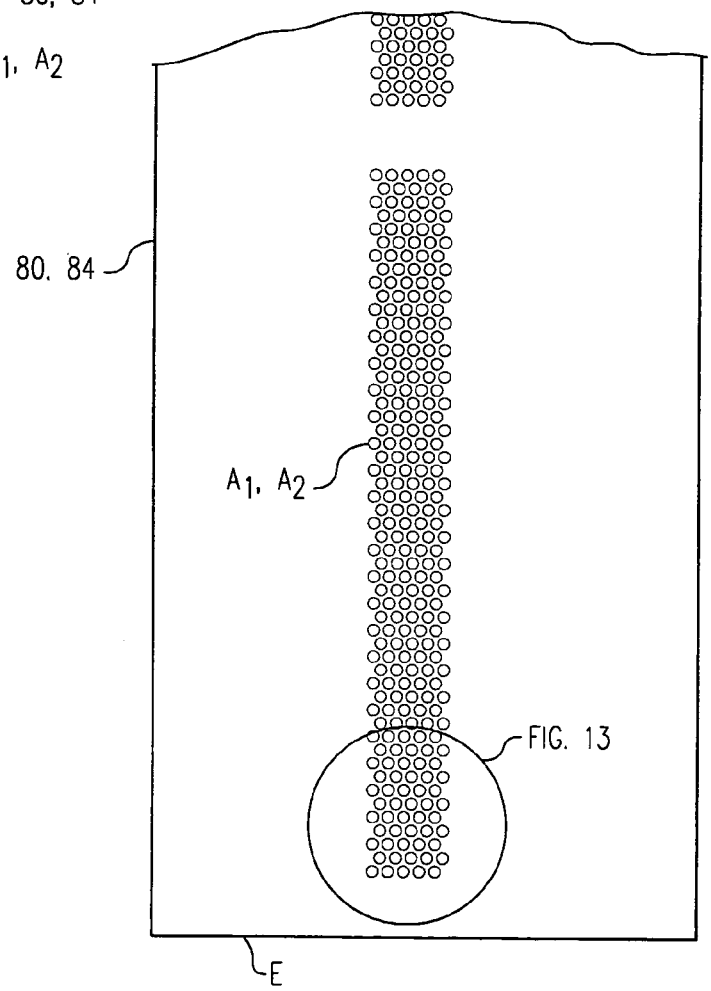
FIG. 12 is a close up view of a portion of FIG. 11, taken to more clearly show construction details of vent apertures.
Figure 13:
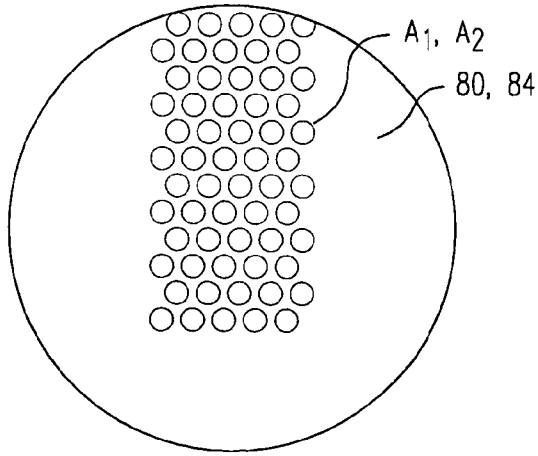
FIG. 13 is yet a closer view of a portion of the sub-flashing shown in FIG. 12, provided to more clearly show construction details of one exemplary type of vent apertures.

In FIG. 1, a view of an exemplary ridge vent flashing is in place on a roof, showing the position of (a) the sub-flashing 80 and 84, and (b) the top cap flashing 120, and including flat tile roofing 100 and the longitudinally oriented ridge cap tiles 130. Also, the various figures provide general views of certain embodiments, without limitation as to details of exact size, for convenience of stocking distributors and for contractor installation, one set of exemplary dimensions for my ridge vent system as applied to flat type tile roofs can be provided, as detailed in FIGS. 11, 12, and 13. For example, sub-flashing 80 and 84 can be provided in convenient widths, often of about 6.5 inch width, when measured flat, before forming into an "S" shape for installation, and in standard lengths of 48 inches. Also, I have found it convenient to provide apertures $A_1$ and $A_2$ spaced at about 0.25 inch centers vertically (Y dimension) and at about 0.20 inch centers longitudinally (X dimension) as also noted in FIG. 3. Also, for strength of sub-flashing 80 and 84, I have found it useful to provide apertures $A_1$ and $A_2$ in rectangular strips of about 10.8 inches long, and slightly over one inch wide, with about 1.2 inch strips of solid metal provided longitudinally between rectangular strips of apertures, and with the first aperture spaced about 1.1 inches from the edge E (see FIG. 12 for this detail). However, these are merely exemplary embodiments and the actual dimensions and sizes may be varied to suit individual needs, without varying from the more general teachings hereof.

Figure 14:
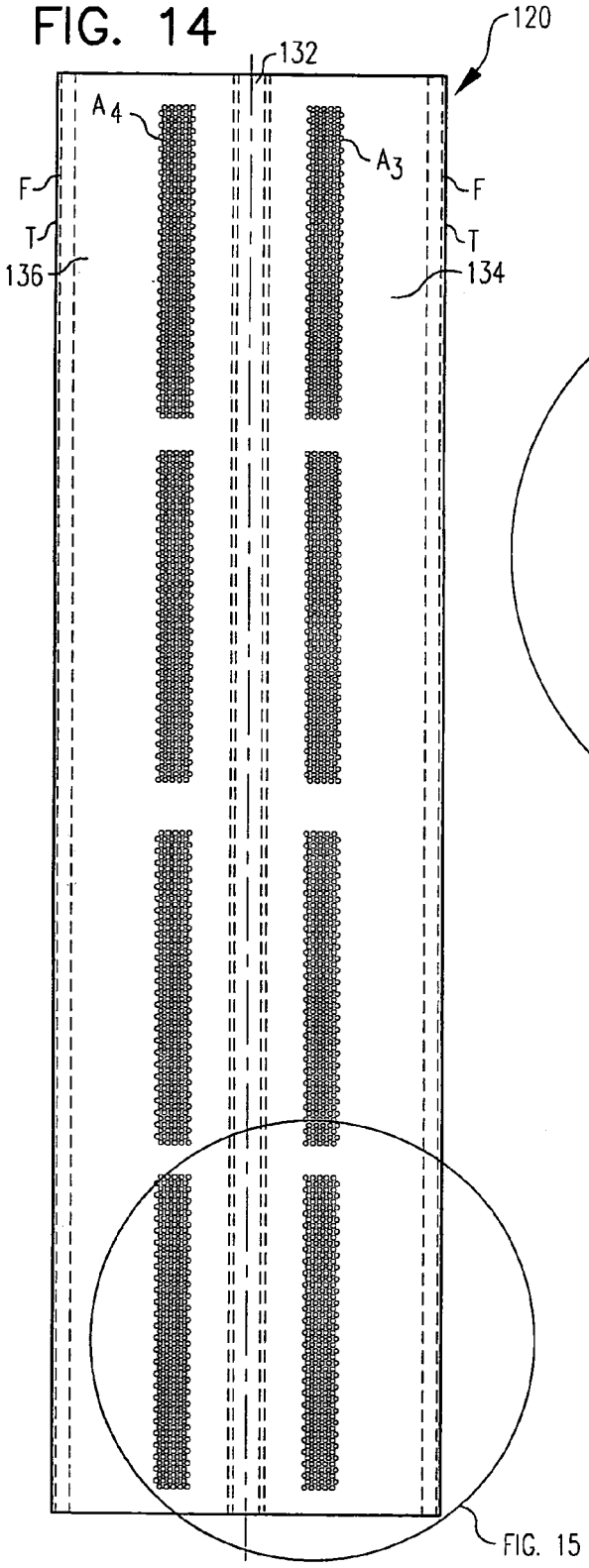
FIG. 14 is a top plan view of a section of top cap flashing for a flat type tile roof, shown flat during manufacture of the top cap flashing, before the top cap flashing is shaped for installation.
Figure 15:
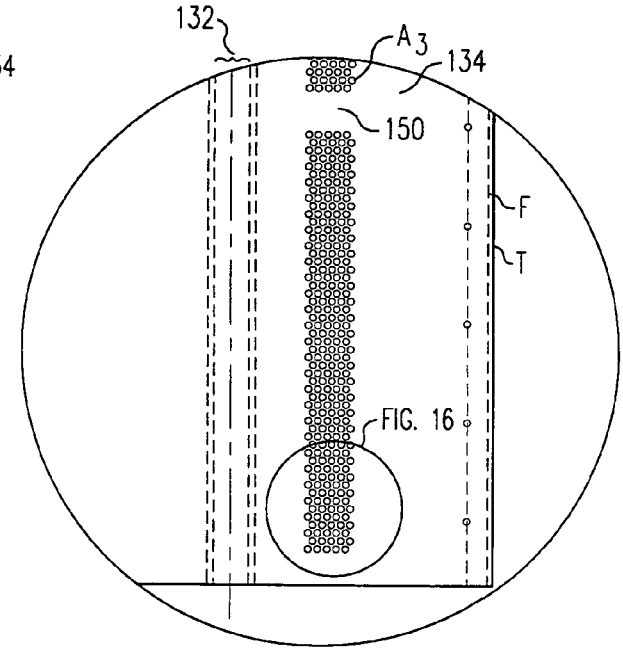
FIG. 15 is a close-up view of a portion of FIG. 14, taken to more clearly show construction details of the top cap flashing.
Figure 16:
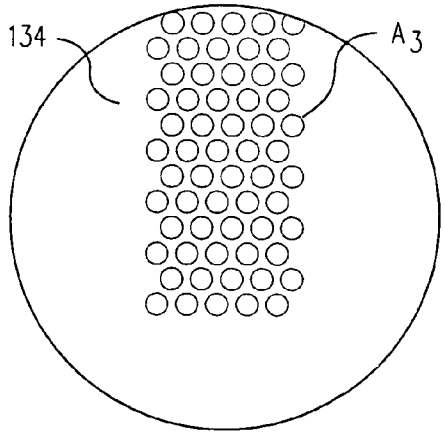
FIG. 16 is yet a closer view of a portion of the top cap shown in FIG. 7, provided to more clearly show construction details of the top cap flashing.
Figure 17:
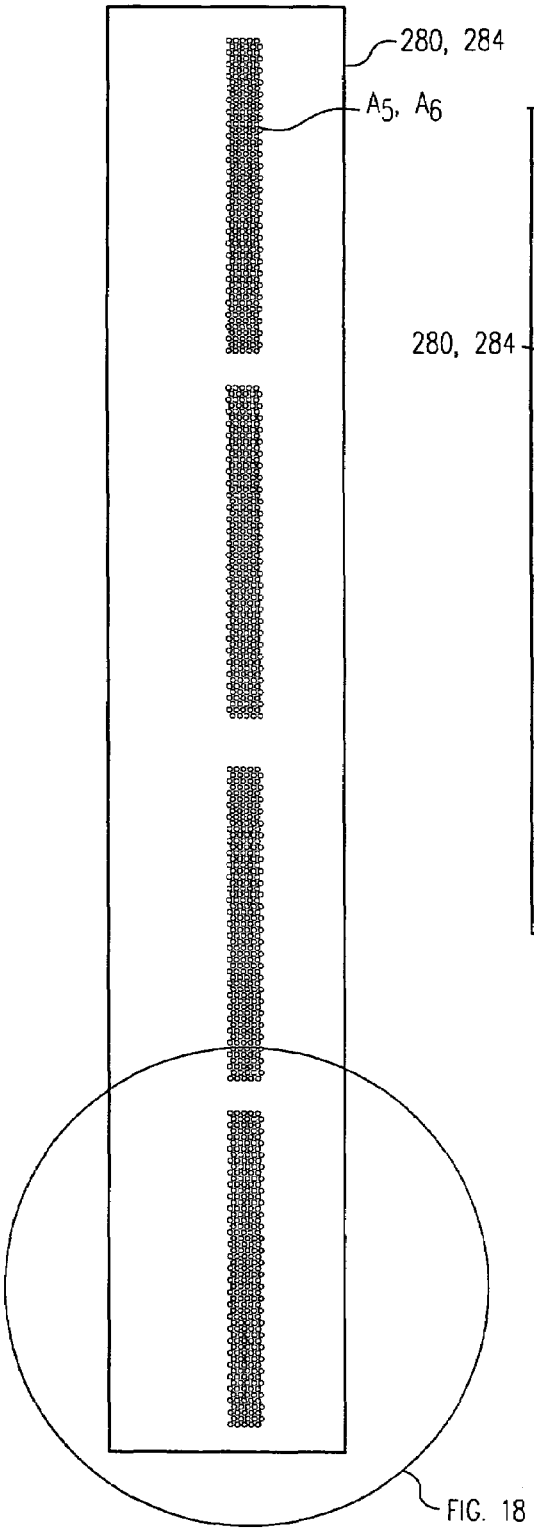
FIG. 17 is a top plan view of a section of sub-flashing, shown flat during manufacture of the sub-flashing for an undulating tile roof, before the sub-flashing is formed and shaped for installation.
Figure 18:
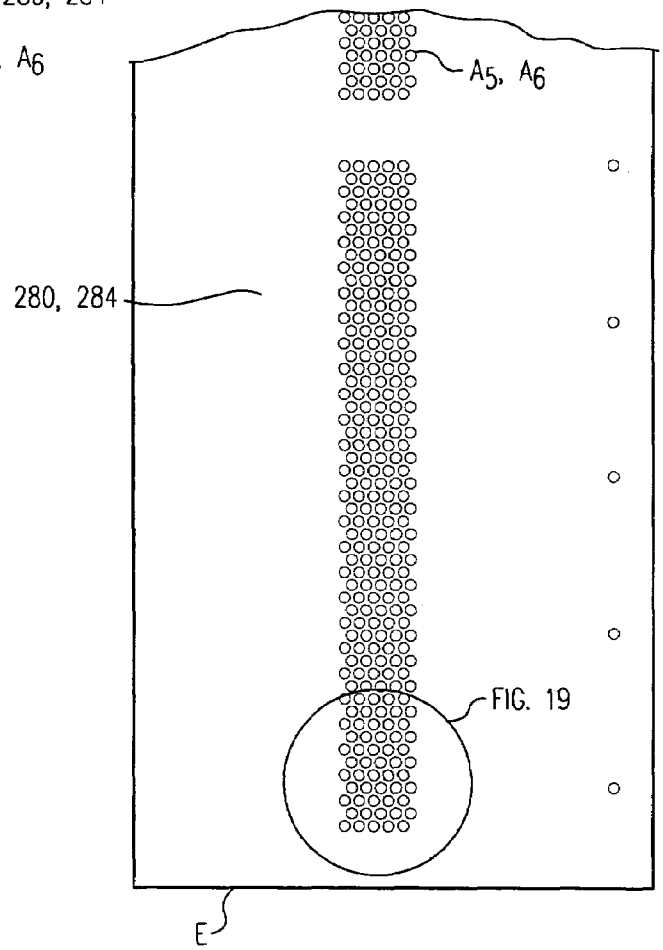
FIG. 18 is a close up view of a portion of FIG. 17, taken to more clearly show construction details of vent apertures.
Figure 19:
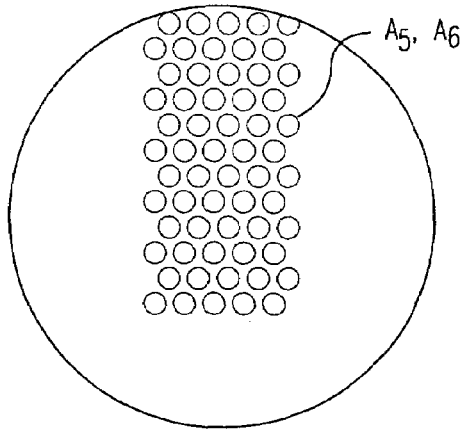
FIG. 19 is yet a closer view of a portion of the sub-flashing shown in FIG. 18, provided to more clearly show construction details of one exemplary type of vent apertures.

Turning now to the top cap 120, FIG. 14 shows a top plan view of a 48 inch long section of top cap flashing 120 for a flat type tile roof, shown flat during manufacture of the top cap flashing in a 14.25 inch width, before the top cap flashing 120 is shaped for installation in the roofing system. Apertures $A_3$ and $A_4$ are provided in generally rectangular strips of about 10.8 inches long, longitudinally spaced apart by solid strengthening portions 150 of about 1.2 inches long, longitudinally (see FIGS. 15 and 16 for this detail). Also, it has been found it convenient to provide apertures $A_3$ and $A_4$ spaced at about 0.25 inch centers vertically and at about 0.20 inch centers longitudinally (see FIG. 15 for this detail). Drain holes 152 are provided, about 0.1875 inches in diameter and spaced inward from tip T about 0.75 inches and spaced longitudinally apart about 2 inches or so (compare FIG. 14 and FIG. 6 for these details).

Returning now to FIGS. 2 and 4, a series of steps in an exemplary method for installing a ridge vent system for flat type tile roofs is shown. A first step in a method of installation of a ridge vent in a flat tile roof system is shown in FIG. 2, wherein the roof decks 42 and 44 are is cut back to provide an air flow space, optionally, but not necessarily U-shaped, defined by edge wall portions 154, and providing space between roof decks 42 or 44 and the center beam 38. Next, a second step involves covering the roof decking 44 with felt 102 prior to tile installation. Next, a third step in a method of installation of the ridge vent in a flat tile roof system, involves installing (a) the sub-flashing 84 is installed, and (b) securing the sub-flashing by use of a top batten 92 which is nailed over the sub-flashing 84, to hold the sub-flashing 84 in place over deck 44. It is easily understood that the first sub-flashing 80 and first batten 90 are similarly installed, either before or after installation of the second sub-flashing and the second batten. Now, a fourth step in a method of installation of a ridge vent in a flat tile roof, includes centering the top cap 120 and fastening it to the ridge beam 40. the top cap flashing 120 is preferably fastened to the ridge beam 40 using a #6 or better galvanized roofing nails N spaced 12 inch on center. Further, as best seen in FIG. 5, a bead of caulking S is used to seal between the bottom 156 of first wing 134 and tile $\mathbf{100}_1$, and between the bottom 158 of second wing 136 and tile $\mathbf{100}_3$.

Figure 4:
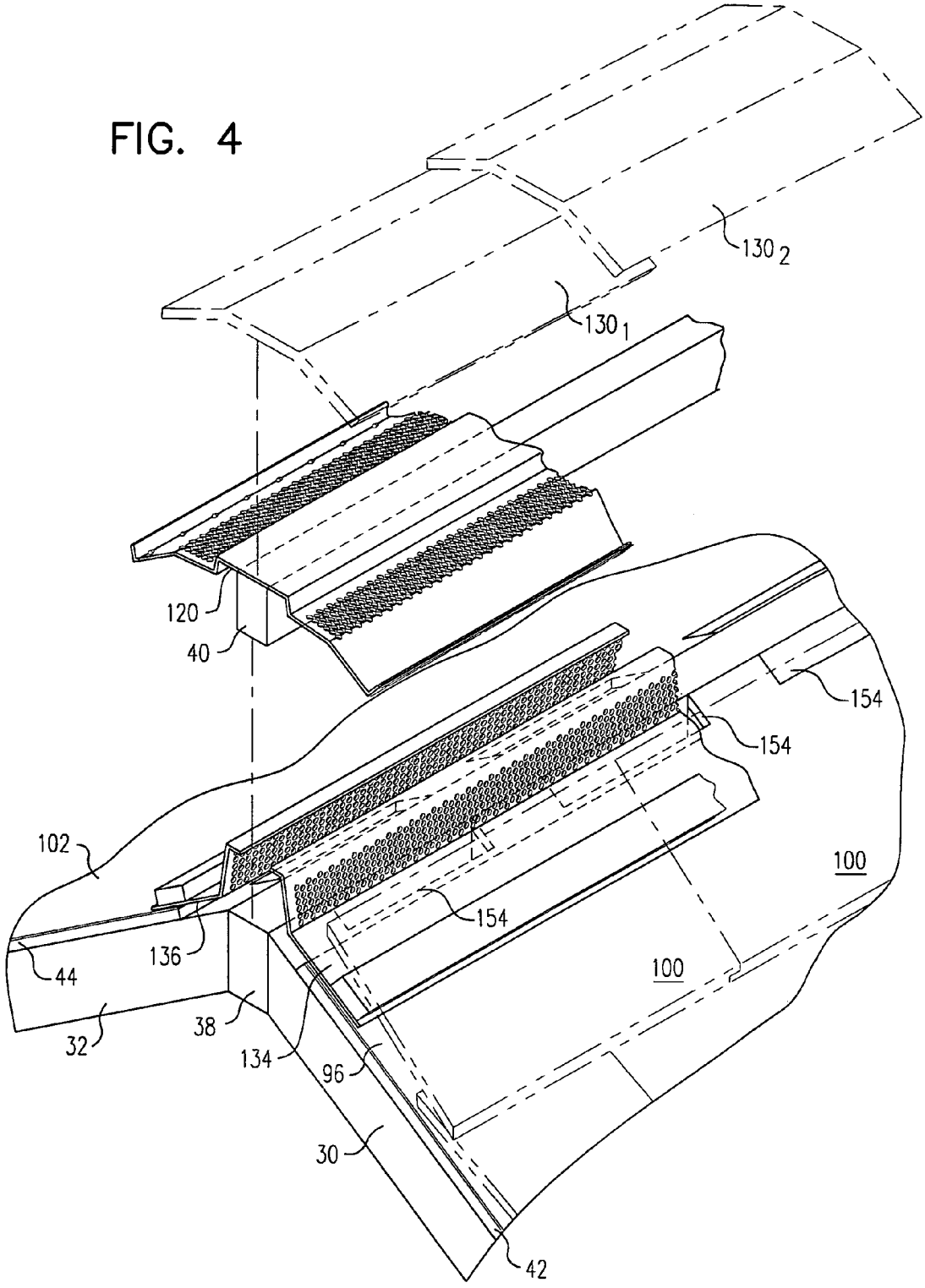
FIG. 4 is an exploded perspective of the roof first shown in FIG. 1, now showing construction details, including the installation of first and second sub flashing portions, and a top flashing portion which is covered by a top cap row of roofing tiles.

In FIG. 4, a fifth step in a method of installation of a ridge vent in a flat type tile roof is shown, wherein the "ridge cap" tiles 130 are centered over the top cap flashing 120, and sealed together per the tile manufacturer's specifications.

Figure 6:
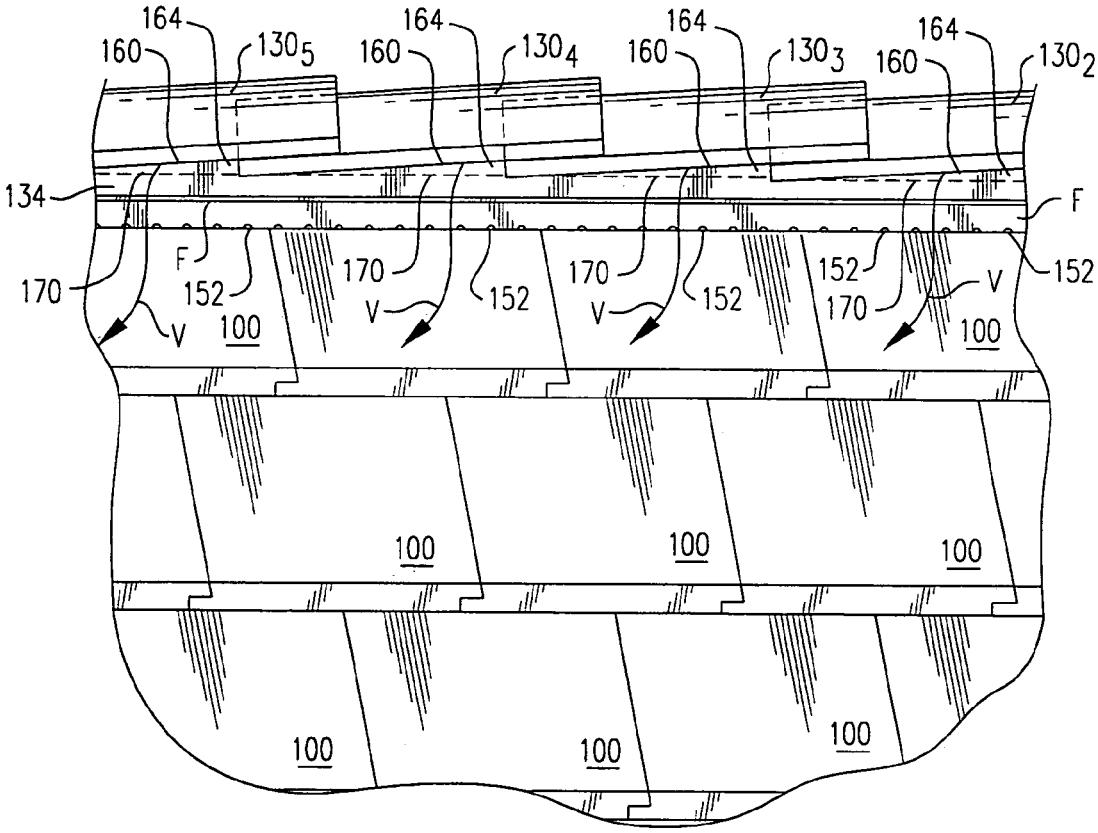
FIG. 6 shows a side view of a finished roof with ridge vent, installed utilizing the ridge vent system disclosed herein, and, in particular, illustrates the generally triangular space below the outer edge of slanted ridge-cap tiles which allows ventilation air to escape outward.
Figure 7:
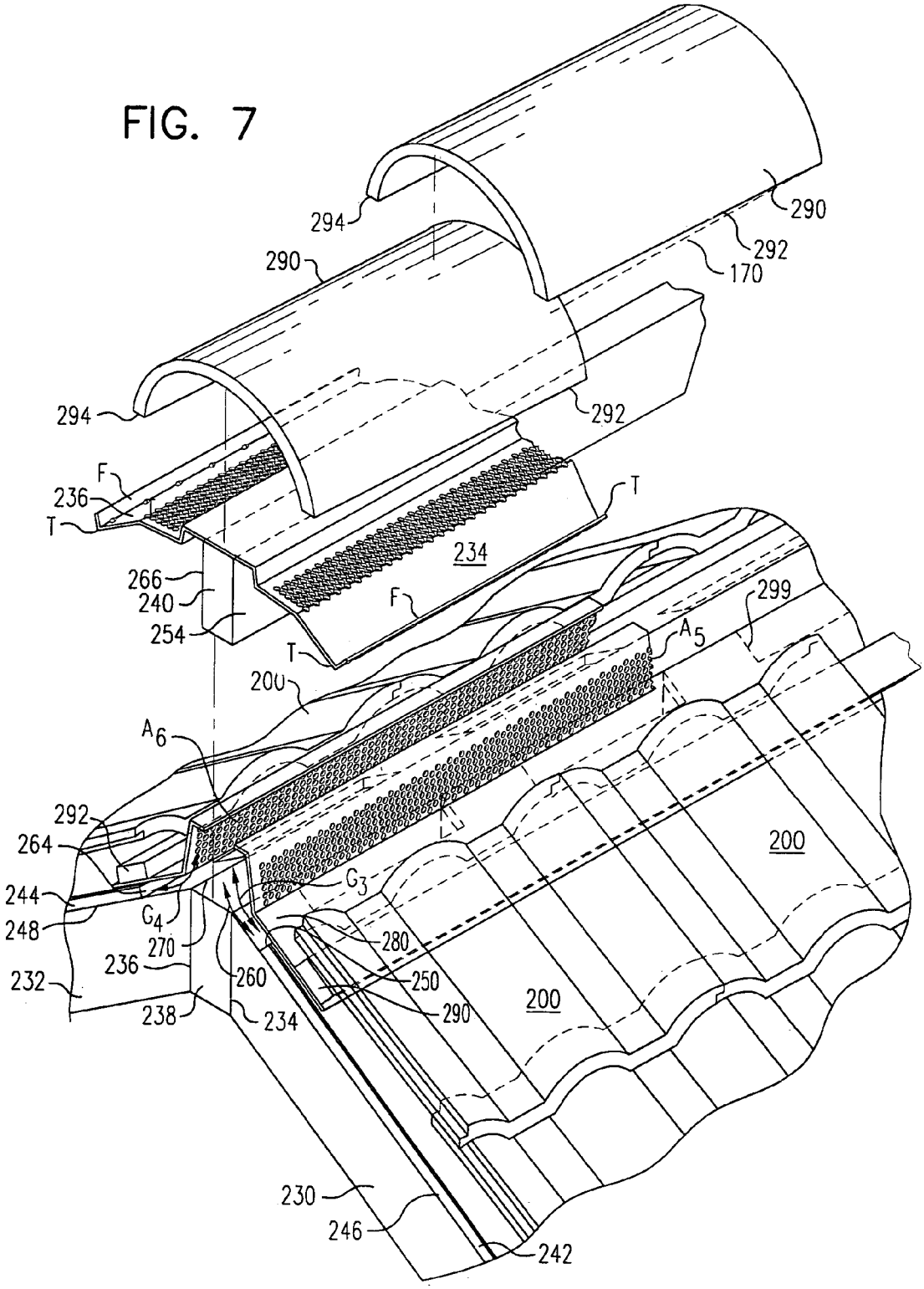
FIG. 7 is an exploded perspective view of the ridge vent system installed in a low profile S-type roofing, further illustrating the version which is useful in "S-tile" or "undulating" type tile roof construction, here showing the use of sub-flashing on both sides of the ridge beam, and a top beam mounted above the ridge beam to support ridge-cap tiles.
Figure 8:
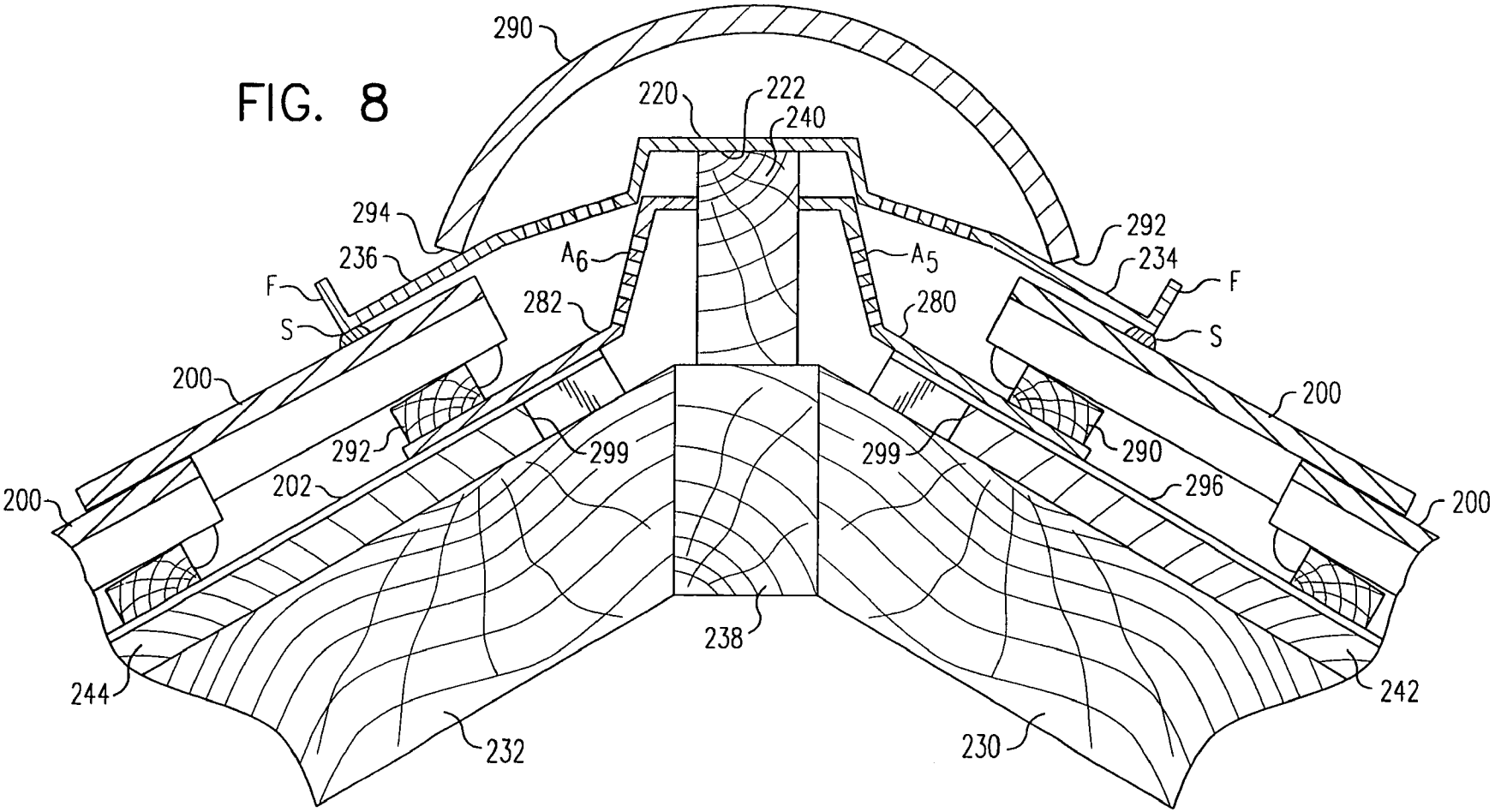
FIG. 8 is a vertical cross-section of a ridge top roof vent installed on a roof having low profile type roofing types as just illustrated in FIG. 7.

To understand the functionality, it should be recognized that air escapes outward (or inward, as the case may be) between the ridge tiles 130 and the top cap flashing 120. More specifically, as shown in FIG. 1 and FIG. 6 between adjacent ridge tiles 130, a slight triangular shaped gap is created between bottom edges 160 and 162. and the upper surface 164 of the top cap flashing 120 therebelow. In FIGS. 1 and 6, the gap is indicated by the area between bottom edges 160 and 162 and the broken line of position 170 therebelow. In other words, from the line of position indicated in broken lines, to the bottom edges 160 and 164 of the ridge tiles 130 directly thereabove, a gap exists through which an adequate amount of ventilation air can escape, as indicated by arrows V in FIG. 1 and FIG. 6. Of course, as shown in FIG. 1, a first laid ridge tile $\mathbf{130}_1$ may be provided flat against top cap flashing 120, or, alternately, a suitable height block may be provided to allow ventilation to occur.

Attention is now directed to FIGS. 7 through 10, where the installation of an exemplary ridge vent in two types of S-tile or "undulating" tile roof is shown. First, in FIGS. 7 and 8, the installation of tile in a low profile type undulating roof is shown. Roof rafters 230 and 232 have ridge ends 234 and 236 ending at a center beam 238. Above the center beam 238 is mounted a longitudinally running ridge beam 240 which extends across the roof system. First 242 and second 244 roof decking is affixed above the upper sides 246 and 248 of the respective rafters 230 and 232. Between the upper end 250 of first roof deck 242 and first side 254 of the ridge beam 240, an air gap $G_3$ is provided to allow air to flow upward or downward in the direction of reference arrow 260. Between the upper end 264 of second roof deck 244 and the second side 266 of ridge beam 240, an air gap G4 is provided to allow air to flow upward or downward in the direction of reference arrow 270.

A first longitudinally extending sub-flashing 280, preferably but not necessarily in a general S-shape, and having a plurality of ventilation apertures $A_5$ therein is provided to span gap $G_3$. A second longitudinally extending sub-flashing 280, preferably but not necessarily in a general S-shape, and having a plurality of apertures $A_6$ therein is provided to span gap $G_4$. A first top batten 290 is provided to affix first sub-flashing 280 to the first roof deck 242. A second top batten 292 is provided to affix the second sub-flashing 282 to the second roof deck 244. Each of first and second top battens 290 and 292 may be secured to first and second roof decks 242 and 244, respectively, by nails or other suitable fasteners N (not shown). Also, a water proof roof felting 296 is provided above first roof deck 242. A similar waterproof roof felting 202 is provided above decking 244. Low profile type roof tiles 200 are shown affixed on the roof.

A top cap flashing 220 is mounted over the top 222 of ridge beam 230. The top cap flashing 220 is longitudinally extending to support a plurality of ridge cap tiles 290, as clearly shown in FIGS. 7 and 8. In the embodiment shown in FIGS. 7 and 8, the top cap flashing 220 has a relatively flat, outwardly spreading center section 232 with a slight downward U-shape, and a pair of opposing first and second outward wing portions 234 and 236, each of which may be bounded at the outer tip T thereof by a an upwardly directed flange portion F. Placement of overlapping ridge cap tiles 290, and resultant generally triangular air gap below the outer edges 292 and 294 thereof, is generally as just described above with respect to the flat tile type of ridge cap.

In FIGS. 17 through 22, I have provided a set of exemplary detailed dimensions for one embodiment of a ridge vent system as applied to undulating tile type roofs. For example, sub-flashing 280 and 284 can be provided in about a 8.5 inch width, when measured flat, before forming into an "S" shape for installation, and in standard lengths of 48 inches (see FIG. 17 for this detail). Also, it is convenient to provide apertures $A_6$ and $A_7$ spaced at about 0.25 inch centers laterally and at about 0.20 inch centers longitudinally (see FIG. 19 for this detail). Also, for strength of sub-flashing 280 and 284, it is useful, but not necessary, to provide apertures $A_6$ and $A_7$ in rectangular strips of about 10.8 inches long, and slightly over one inch wide, with about 1.2 inch strips of solid metal provided longitudinally between rectangular strips of apertures, and with the first aperture spaced about 1.1 inches from the edge E (see FIG. 18 for this detail).

Figure 20:
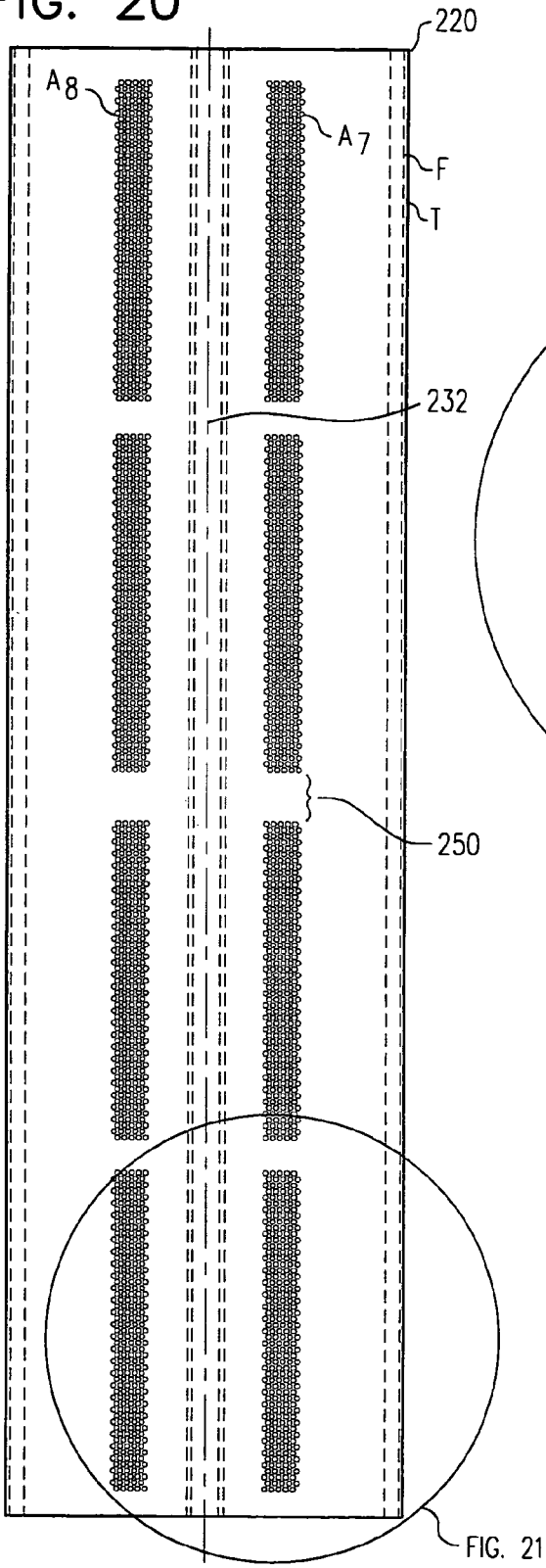
FIG. 20 is a top plan view of a section of top cap flashing for use on an undulating type tile roof, shown flat during manufacture of the top cap flashing, before the top cap flashing is shaped for installation.
Figure 21:
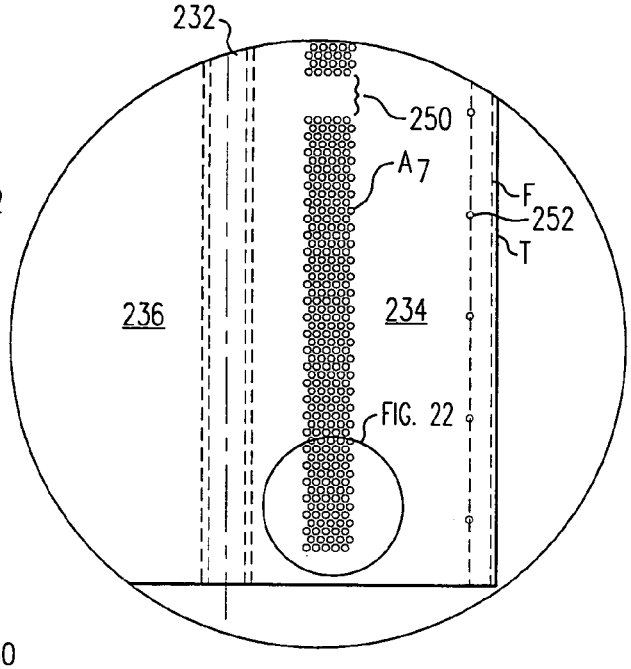
FIG. 21 is a close-up view of a portion of FIG. 20, taken to more clearly show construction details of the top cap flashing.
Figure 22:
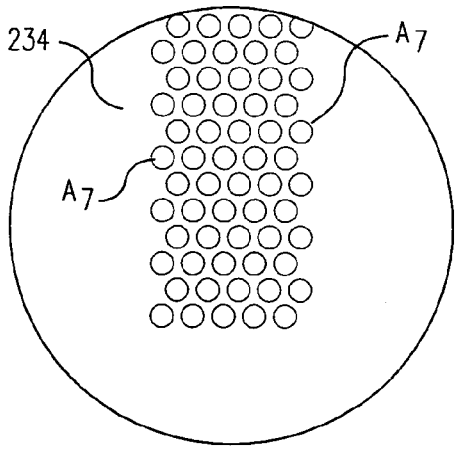
FIG. 22 is yet a closer view of a portion of the top cap shown in FIG. 21, provided to more clearly show construction details of the top cap flashing.

Attention is now directed to FIG. 20, where the top cap 220 is shown. In this figure, a top plan view of a 48 inch long section of top cap flashing 220 for an S-tile type roof is provided, shown flat during manufacture of the top cap flashing in a 15.5 inch width, before the top cap flashing 220 is shaped into generally recognized W-shape for installation in a roofing system. Apertures $A_7$ and $A_8$ are provided in generally rectangular strips of about 10.8 inches long, longitudinally spaced apart by solid strengthening portions 250 of about 1.2 inches long (see FIGS. 21 and 22 for this detail). Also, I have found it convenient to provide apertures $A_7$ and $A_8$ spaced at about 0.25 inch centers laterally and at about 0.20 inch centers longitudinally (see FIG. 22 for this detail). Drain holes 252 are provided, about 0.1875 inches in diameter and spaced inward from tip T about 0.75 inches and spaced longitudinally apart about 2 inches or so (see FIG. 20 for these details).

A method of installing a ridge vent system for an S-tile (undulating) type tile roof system can be easily understood in view of the previously provided method for installing an exemplary roof vent system for a flat tile roof. A first step in a method of installation of an exemplary ridge vent in an S-tile roof system is shown, wherein the roof deck 244 is cut back from the center beam 238 and the ridge beam 240 in the roof, to provide an aperture defined by edge wall 299. A second step in a method of installation of a ridge vent in an S-type tile roof system is to cover roof decking 244 with a conventional roofing felt 296 prior to installation of the tiles 200. Next, a third step in a method of installation of a ridge vent in an S-tile roof system, involves (a) installing the sub-flashing 284, and (b) installing a top batten 292 by nailing it over the sub-flashing 284, to hold the sub-flashing 284 in place. Although the second sub-flashing and second batten installation procedure is discussed, it is easily understood that the first sub-flashing 280 and first batten 290 are similarly installed, either before or after installation of the second sub-flashing and the second batten. Now, a fourth step in a method of installation of a ridge vent in an S-tile roof, involves centering the top cap 220 and fastening it to the ridge beam 240; this is preferably accomplished using a #6 or better galvanized roofing nails N spaced 12 inch on center. Finally, a fifth step in an exemplary method of installation of a ridge vent in a tile roof system is to install the "ridge cap" tiles 290, centered over the top cap 220 flashing, and sealing the ridge cap tiles per the tile manufacturer's specifications.

Figure 3:
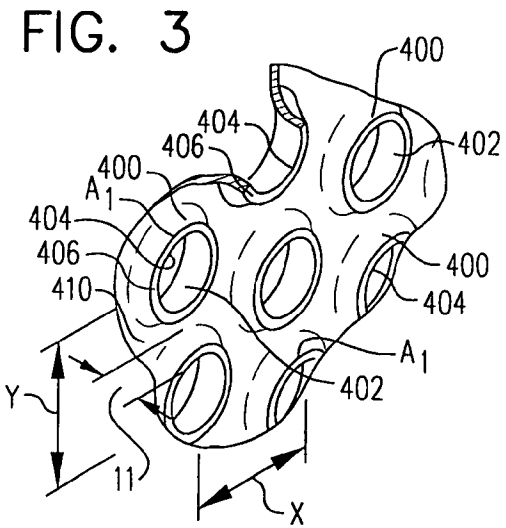
FIG. 3 is a perspective view of a portion of the vent apertures in flashing, provided to more clearly show construction details of vent apertures.
Figure 9:
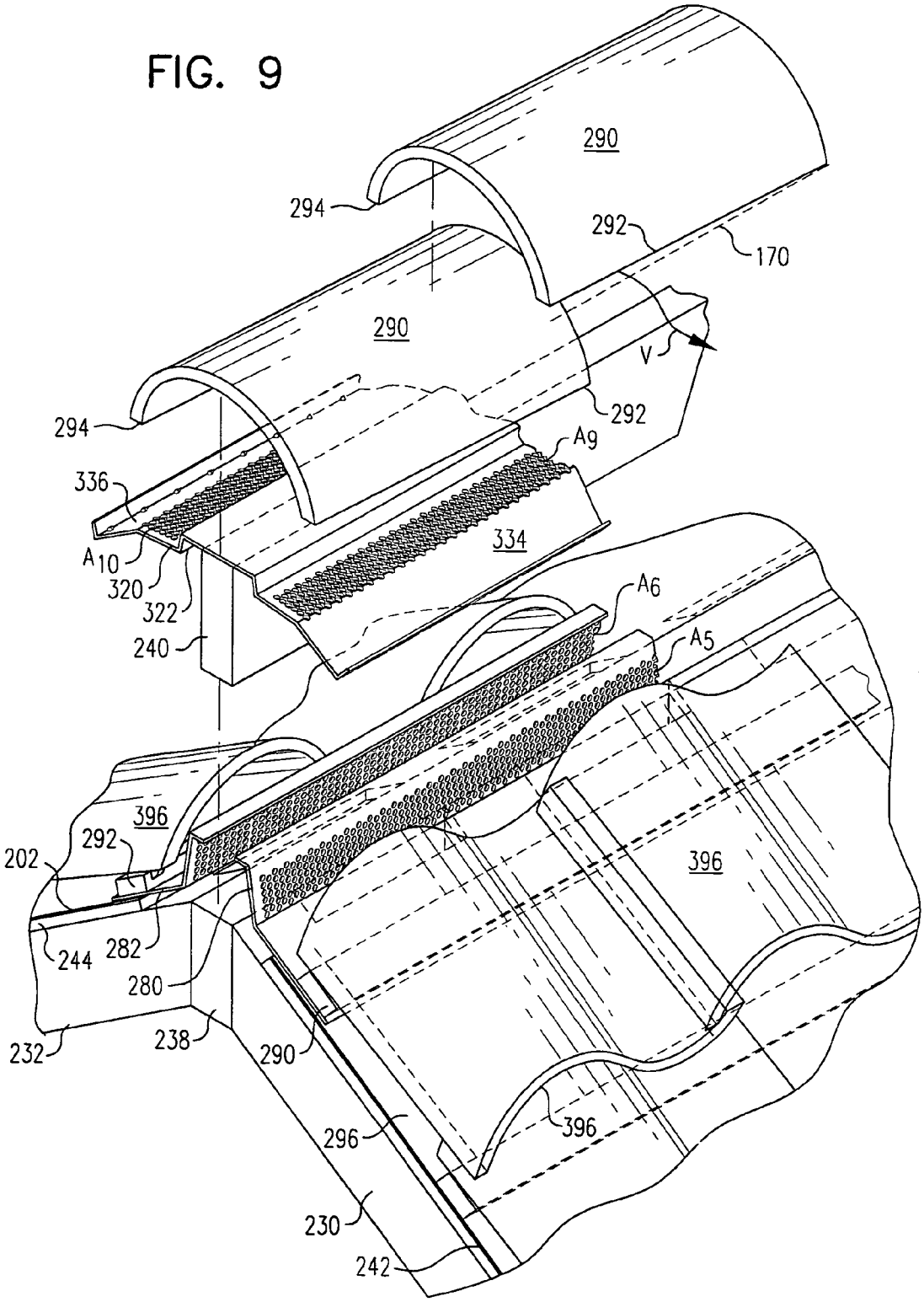
FIG. 9 is an exploded perspective of view of a ridge vent system adapted for use in S-tile roofing.
Figure 10:
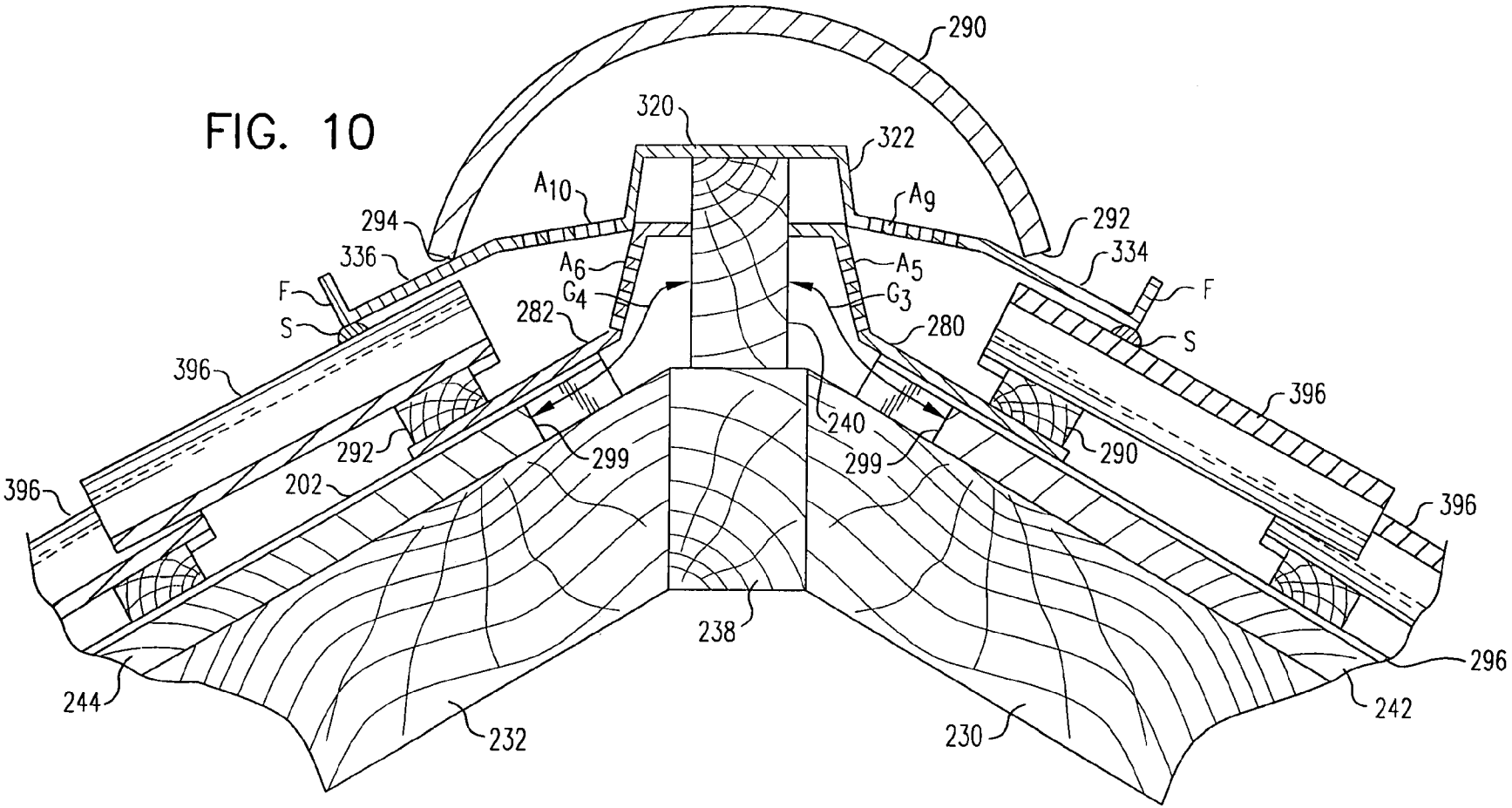
FIG. 10 is a vertical cross-section of a ridge top roof vent installed on a roof having an S-tile roof as just illustrated I FIG. 9 above.

In FIGS. 9 and 10, yet another embodiment of a ridge vent for tile roofs is illustrated, wherein the top cap flashing 320 includes a slight downwardly U-shaped center section 322. This top cap flashing section 320 is provided with apertures $A_9$ and $A_{10}$ each of which are defined by edge portions, preferably as illustrated in FIG. 3 with respect to apertures $A_1$. Wing portions 334 and 336 are similar to portion 234 and 236 previously described. Otherwise, larger S-shaped tiles 396 are provided, but remaining parts are structurally and functionally the same as previously identified with respect to the discussion of FIGS. 7 and 8, and thus the parts are identified accordingly.

In the various sub-flashing and top cap flashing designs, apertures are provided for passage of air therethrough. It is also a desirable function of such apertures, whether $A_1$, $A_2$, $A_3$, $A_4$, $A_4$, $A_6$, $A_7$, or $A_8$ to resist the passage of water therethrough. Consequently, note that an exemplary design applicable to any of the just mentioned apertures is set forth in FIG. 3. Rather than the provision of a mere punched hole, in one embodiment it has been found desirable to provide the apertures in an outwardly directed "volcano" or "cheese grater" shape, wherein water that is wind blown from the outside does not funnel toward passage through the aperture. In contrast, water would have to hit the aperture opening itself, since sloping sidewalls 400 provide for a narrow throat 402 that ends at the interior periphery (circumference 404 as shown in FIG. 3) of the preferably annular face portion 406. Thus, the "volcano" shaped vent apertures protrude, in the outward direction (against ingress of water) for a preselected height H, as shown in FIG. 3, which height H may vary depending upon the desired ventilation and water intrusion results to be achieved. And, as currently seen in the embodiment depicted in FIG. 10, ingress of water is further thwarted when the intermost aperture $A_9$ in the top cap flashing 320 is laterally outward with respect to the intermost aperture (below $A_5$) in the subflashing 280, for example.

Although the various embodiments of an exemplary ridge vent design have been described herein in detail, it is important to note that such ridge vents have been tested according to the Metro Dade County Florida Number PA100 (A)-95 Test Procedure for Wind and Wind Driven Rain Resistance, and the designs described herein passed such testing. In particular, the test results indicated that there was no lift of movement of any tile or ridge vent components during the test. Also, the amount of water which entered through the vent opening during the test was well below the regulatory limits. In one test, 830,720 ml of water was delivered to an 8 foot by 6 foot test roofing area during 50 minutes of testing. In that test, the maximum amount of water infiltration allowable, per the test procedure, was 0.05% of the water delivered to the test area. Given the delivered quantity of water, a maximum of 415 ml was the regulatory limit established for the test. However, the novel ridge vent system disclosed and claimed herein was able to limit water passage to a total of only 194 ml; in other words only 0.023% of the water which was applied to the roof deck tested actually passed through the ridge vent system.

In another test, where the ridge vent system was tested on a High Profile Spanish "S" Tile type roof, a total of 830,720 ml of water was delivered to an 8 foot by 6 foot test area during 50 minutes of testing. Again, the maximum amount of water infiltration per the test procedure was 0.05% of the water delivered to the test area, or, given the delivered quantity of water, a maximum of 415 ml of leakage was permissible during the test. However, the test, as conducted by outside engineering experts, determined that only 1 ml of water (0.0001%) of the water applied to the test deck entered the vent opening throughout the test. It is interesting that a portion of the two tests involved simulated rainfall of 8.8 inches per hour during wind velocity tests of 35 mph, 70 mph, 90 mph, and 110 mph. Moreover, during the tests, there was no lift or movement of tile or vent components. These results were totally unexpected by the test facility. Thus, the performance of the ridge vent design set forth herein represents an important advance in the state of the art of ridge vents for tile roofs.

It is to be appreciated that the novel ridge vent system provided by way of the present invention is a significant improvement in the state of the art of ridge type roof vents for tile roofs. The vent is lightweight, being normally manufactured of lightweight metal or other structurally strong material, and is capable of being easily packaged and shipped.

Importantly, the ridge vent for tile roofs allows installation of a ridge vent system even in locales where it has heretofore been impossible to do so and comply with building code requirements, since the ridge vent system is fully capable of passing the most stringent regulatory tests for wind and wind driven rain resistance.

Although only a few exemplary embodiments and aspects of this invention have been described in detail, various details are sufficiently set forth in the drawing and in the specification provided herein to enable one of ordinary skill in the art to make and use such exemplary embodiments and aspects, which need not be further described by additional writing in this detailed description. Importantly, the designs described and claimed herein may be modified from those embodiments provided without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Numerous modifications and variations of the present invention are possible in light of the above teachings. It is therefore to be understood that within the scope of the appended claims, the invention may be practiced otherwise than as specifically described herein. Thus having described some embodiments of the invention, though not exhaustive of all possible equivalents, what is desired to be secured by letters patent is claimed below. Therefore, the scope of the invention, as set forth in the appended claims, and as indicated by the drawing and by the foregoing description, is intended to include variations from the embodiments provided which are nevertheless described by the broad interpretation and range properly afforded to the plain meaning of the claims set forth below.

The invention claimed is:

1. A roof vent, said roof vent adapted for placement over an opening in the upper reaches of tile roof in a roof system comprising a central beam and opposing roof decks, said roof vent comprising:

(a) a pair of opposing, longitudinally extending sub-flashing portions, each of said sub-flashing portions having
  (i) edge portions adapted for engagement with said central beam,
  (ii) a plurality of sub-flashing vent apertures defined by edge wall portions, and
  (iii) a portion adapted for engagement with one of said opposing roof decks;

(b) a top cap, said top cap comprising
  (i) a central portion, said central portion adapted to be secured to said central beam, and
  (ii) opposing first and second wing portions, each of said opposing first and second wing portions extending laterally outward from said central beam to a tip end, and
  (iii) each of said first and said second wing portions having therein a plurality of top cap vent apertures defined by edge wall portions.

2. The roof vent as set forth in claim 1, wherein said sub-flashing vent apertures are spaced laterally inwardly from said top cap vent apertures.

3. The roof vent as set forth in claim 1, wherein each of said sub-flashing portions comprises a generally S-shaped length of thin perforated metal.

4. The roof vent as set forth in claim 1 or in claim 3 wherein each of said sub-flashing portions comprise (a) a first body panel, said first panel having an edge portion adapted for engagement with said central ridge beam, (b) a second body panel, said second body panel having therein a plurality of sub-flashing vent apertures defined by edge wall portions, and (c) a third body panel, said third body panel adapted for engagement with one of said opposing roof decks.

5. The roof vent as set forth in claim 1, wherein said top cap further comprises, at the tip end of each wing thereof, an upwardly extending flange portion.

6. The roof vent as set forth in claim 5, wherein said top cap further comprises, adjacent the tip end of said first and of said second wing portions, plurality of drain apertures.

7. The roof vent as set forth in claim 1, wherein said top cap is provided in a length of 48 inches.

8. The roof vent as set forth in claim 1, wherein said sub-flashing portions are provided in a length of 48 inches.

9. The roof vent as set forth in claim 1, wherein said sub-flashing further comprises a plurality of nail guide portions, said nail guide portions having a wall defining portion defining a void suitable for receiving a nail therethrough.

10. The roof vent as set forth in claim 1, wherein said top cap portion further comprises a pair of transverse oriented wing portions, said wing portions extending outwardly and downwardly from said central portion.

11. The roof vent as set forth in claim 10, wherein said central portion comprises a generally U-shaped downward attachment portion, said attachment portion adapted for close fitting engagement with said central beam.

12. The roof vent as set forth in claim 1, wherein said sub-flashing apertures in said sub-flashing are provided in groups of apertures, and wherein said groups of apertures are provided in a plurality of generally rectangularly shaped fields.

13. The roof vent as set forth in claim 12, wherein said generally rectangularly shaped fields are spaced apart, longitudinally, by an aperture free stiffening section.

14. The roof vent as set forth in claim 1, wherein at least some of said sub-flashing vent apertures have an outwardly directed volcano shape with a centrally located opening.

15. The roof vent as set forth in claim 1, wherein at least some of said top cap flashing vent apertures have an outwardly directed volcano shape with a centrally located opening.

16. The roof vent as set forth in claim 14, wherein said sub-flashing vent apertures protrude outwardly from a base portion by a preselected height H.

17. The roof vent as set forth in claim 15, wherein said top cap flashing vent apertures protrude outwardly from a base portion by a preselected height H.

18. The combination of a ridge vent and a tile roof, said tile roof of the type comprising a plurality of roof rafters, a roofing deck above said roof rafters, a central beam, and an air gap between said roof rafters and said central beam, said ridge vent comprising:

(a) a sub-flashing portion, said sub-flashing portion adapted to close said air gap, said sub-flashing portion comprising a plurality of sub-flashing ventilation apertures therethrough;

(b) providing a top cap flashing, said top cap flashing mounted above said central beam, said top cap flashing comprising a plurality of top cap ventilation apertures defined by edge portions;

(c) a plurality of roofing tiles above said roof deck;

(e) a plurality of ridge cap tiles above said top cap flashing, said ridge cap tiles in a successive stacked fashion to provide a plurality of ventilation spaces between said ridge cap tiles and said top cap flashing.

19. The combination of a tile roof and a ridge vent, said combination comprising:

(a) a roof system comprising (i) a central beam having an attic space therebelow, (ii) opposing roof decks, (iii) a plurality of roof deck tiles, and (iv) a plurality of ridge cap tiles;

(b) a pair of opposing, longitudinally extending sub-flashing portions, each of said sub-flashing portions comprising (i) edge portions adapted for engagement with said central beam, (ii) a plurality of sub-flashing vent apertures defined by edge wall portions, and (iii) a portion adapted for engagement with one of said opposing roof decks;

(c) a top cap, said top cap comprising (i) a central portion, said central portion adapted to be secured to said central beam, and (ii) opposing first and second wing portions, each of said opposing first and second wing portions extending laterally outward from said central beam to a tip end, and (iii) each of said first and said second wing portions having therein a plurality of top cap vent apertures defined by edge wall portions;

(d) wherein said roof deck tiles are secured above said roof deck, and wherein said roof ridge tiles are secured above said top cap, and wherein a ventilation space is provided below at least a portion of the lateral margin of said ridge cap tiles, so that air may enter or leave said attic space by passing (i) through said ventilation space, and (ii) through said plurality of sub-flashing vent apertures in said second body panel of said sub-flashing, and (iii) through said plurality of top cap vent apertures in said first or said second wing portions of said top cap.

20. The combination as set forth in claim 18 or in claim 19, wherein said ventilation space beneath said lateral margin of said ridge cap tiles is generally triangular in shape.

21. The combination as set forth in claim 18 or in claim 19, wherein said ridge cap tiles are sealed to at least a portion of said top cap flashing.

22. The combination as set forth in claim 18 or in claim 19, wherein said roofing tiles comprise S-shaped tiles.

23. The combination as set forth in claim 22, wherein a weather tight seal is provided between said S-shaped tiles and said top cap flashing.

24. The combination as set forth in claim 18 or in claim 19, wherein said roofing tiles are flat tiles.

25. The combination as set forth in claim 24, wherein a weather tight seal is provided between said flat tiles and said top cap flashing.

26. A top cap for a roof vent system for placement on a tile roof having a central beam and opposing roof decks supported by rafters, said top cap comprising:

(a) a central portion, said central portion adapted to be secured to said central beam, and (b) opposing first and second wing portions, each of said opposing first and second wing portions extending laterally outward from said central portion to a tip end, and wherein each of said first and said second wing portions have therein a plurality of top cap vent apertures defined by edge wall portions.

27. The top cap as set forth in claim 26, wherein each of said top caps further comprise, adjacent the tip end of said first and of said second wing portions, a plurality of weep holes, said weep holes, said weep holes adapted to allow liquid to drain therethrough.

28. The top cap as set forth in claim 26, wherein said top cap further comprises, at the tip end of each wing thereof, an upwardly extending flange portion.

29. The top cap as set forth in claim 26, wherein at least some of said top cap flashing vent apertures have an outwardly directed volcano shape with a centrally located opening.

30. The top cap as set forth in claim 29, wherein said top cap apertures protrude outwardly from a base portion by a preselected height H.

31. The top cap as set forth in claim 26, wherein said top cap is provided in a length of 48 inches.

32. A method of installing a ridge vent in a tile roof, said tile roof of the type comprising a central beam and a plurality of roof rafters, and a roofing deck above said roof rafters, said method comprising:

(a) creating an air gap between at least a portion of said central beam and said roofing deck;

(b) providing a sub-flashing to close said air gap, said sub-flashing comprising a plurality of sub-flashing ventilation apertures therethrough;

(c) providing a top cap flashing, said top cap flashing mounted above said central beam, said top cap flashing comprising a plurality of top cap ventilation apertures defined by edge portions;

(d) installing a plurality of roofing tiles above said roof deck;

(e) securely installing a plurality of ridge cap tiles above said top cap flashing, and orienting said ridge cap tiles in a successive stacked fashion to provide a plurality of ventilation spaces between said ridge cap tiles and said top cap flashing.

33. The method as set forth in claim 32, wherein said top cap ventilation apertures are spaced laterally outward beyond said sub-flashing ventilation apertures.

34. The method as set forth in claim 32, wherein said sub-flashing apertures are spaced laterally inwardly from said top cap ventilation apertures.

35. The method as set forth in claim 32, wherein at least some of said sub-flashing vent apertures are provided with an outwardly directed volcano shape with a centrally located opening.

36. The method as set forth in claim 32, wherein at least some of said top cap flashing vent apertures are provided with an outwardly directed volcano shape with a centrally located opening.

* * * * *